US005341785A

United States Patent [19]

Meaney

[11] Patent Number: 5,341,785

[45] Date of Patent: Aug. 30, 1994

[54] FUEL DELIVERY SYSTEM FOR INTERNAL COMBUSTION ENGINES

[75] Inventor: John D. Meaney, Hartland, Mich.

[73] Assignee: Echlin, Inc., Branford, Conn.

[21] Appl. No.: 915,268

[22] Filed: Jul. 20, 1992

[51] Int. Cl.[5] ..... F02M 39/00

[52] U.S. Cl. ..... 123/452; 123/458; 123/462

[58] Field of Search ..... 123/452, 456, 457, 460, 123/458, 462

[56] References Cited

U.S. PATENT DOCUMENTS

| | | | |
|---|---|---|---|
| 3,460,520 | 8/1969 | Huber | 123/452 |
| 3,703,888 | 11/1972 | Eckert et al. | 123/452 |
| 3,872,850 | 3/1975 | Littlehales | 123/462 |
| 3,915,138 | 10/1975 | Eckert et al. | 123/452 |
| 3,927,652 | 12/1975 | O'Neill | 123/457 |
| 3,974,809 | 8/1976 | Stumpp et al. | 123/452 |
| 4,015,571 | 4/1977 | Stumpp | 123/452 |
| 4,075,995 | 2/1978 | Kramer | 123/452 |
| 4,469,070 | 9/1984 | Rassey | 123/462 |
| 4,549,515 | 10/1985 | Maisch | 123/452 |
| 4,598,685 | 7/1986 | Logie et al. | 123/458 |
| 4,617,898 | 10/1986 | Gayler | 123/460 |
| 4,745,903 | 5/1988 | Gmelin | 123/452 |
| 4,838,232 | 6/1989 | Wich | 123/458 |
| 4,909,220 | 3/1990 | Field et al. | 123/452 |

*Primary Examiner*—E. Rollins Cross
*Assistant Examiner*—Thomas N. Moulis
*Attorney, Agent, or Firm*—Barnes, Kisselle, Raisch, Choate, Whittemore & Hulbert

[57] ABSTRACT

A fuel delivery system for internal combustion engines that includes a source of fuel under pressure, fuel lines for feeding fuel to the individual cylinders of the engine, and a distributor for metering fuel under pressure from the source to the individual fuel lines. The fuel metering distributor includes a fuel cavity coupled to the fuel source for receiving fuel under pressure, apertures in the sidewall of the cavity coupled to associated individual fuel lines, and a piston slidably disposed in the cavity for opening the individual apertures to the cavity as a function of position of the piston within the cavity. A linear electromagnetic actuator is coupled to the piston for controlling position of the piston within the cavity as a function of engine operating conditions. In the preferred embodiment of the invention, the apertures comprise circumferentially spaced slits positioned in the cavity sidewall so that all of the slits have identical cross sectional openings to fuel flow for a given position of the piston within the cavity. Thus, fuel is automatically identically metered to all of the engine cylinders through operation of a single actuator, thereby eliminating individual electromagnetic fuel injectors at the various engine cylinders.

13 Claims, 2 Drawing Sheets

ALTERNATE FUELS LINEAR ACTUATOR METERING ASSEMBLY

ALTERNATE FUELS LINEAR ACTUATOR METERING ASSEMBLY

FUEL DELIVERY SYSTEM FOR INTERNAL COMBUSTION ENGINES

The present invention is directed to fuel delivery systems for internal combustion engines, and more particularly to a device for metering fuel to individual cylinders of a multiple-cylinder engine.

BACKGROUND AND OBJECTS OF THE INVENTION

In conventional fuel delivery systems for internal combustion engines, a constant-delivery fuel pump supplies fuel under pressure from a tank to a fuel rail positioned on the engine. Excess fuel is returned to the supply tank by a pressure regulator coupled to the fuel rail for maintaining substantially constant fuel pressure within the fuel rail. A plurality of fuel injectors are mounted between the fuel rail and the engine intake manifold, with the injector nozzles being positioned adjacent to the fuel/air intake ports of the individual engine cylinders. The fuel injectors are individually electromagnetically actuated by an engine control unit as a function of operating conditions and parameters at the engine.

A major cost associated with fuel delivery systems of the described character lies in the individual fuel injectors, and in the complexity of electrical conductors that connect the fuel injectors to the engine control unit. The fuel injectors are subject to wear, and may eventually feed differing quantities of fuel to the cylinders even when actuated for nominally identical time durations, thus resulting in less than optimum engine operation. Furthermore, conventional fuel injectors present additional difficulties when employed in conjunction with so-called alternative fuels. Fuels of this character have lower lubricity than conventional gasoline fuels, increasing wear at the individual injectors. The injector wear parts may be constructed of stainless steel, for example, which reduces wear but greatly increases cost. Moreover, because of lower energy content of alcohol-based alternative fuels, for example, the injectors must have a larger fuel opening and/or remain open longer than would otherwise be desirable in operation with gasoline. Thus, conventional fuel injectors are not well suited for use in association with engines intended for operation with alternative fuels having differing potential energy contents.

A general object of the present invention is to provide a fuel delivery system for internal combustion engines in which conventional electromagnetic fuel injectors are eliminated, thereby achieving reduced cost, reduced complexity, reduced wear and increased operating life as compared with conventional systems of the character described above. Another and related object of the present invention is to provide a fuel delivery system in which identical quantities of fuel are automatically delivered to all of the engine cylinders, and in which fuel quantity may be automatically controlled over a wide flow range for uses in conjunction with multiple fuel types without requiring adjustment by an operator or engine technician.

SUMMARY OF THE INVENTION

A fuel delivery system for internal combustion engines in accordance with the present invention includes a source of fuel under pressure, fuel lines for feeding fuel to the individual cylinders of the engine, and a distributor for metering fuel under pressure from the source to the individual fuel lines. The fuel metering distributor includes a valve for selectively controlling flow of fuel into the fuel lines. The valve features a linear electromagnetic actuator for controlling the valve as a function of engine operating conditions. The valve and actuator are both continuously variable between fully closed and fully open conditions at the valve.

In one embodiment, the valve comprises a piston slidably disposed in a cavity for opening individual apertures in the sidewall of the cavity as a function of position of the piston within the cavity. In the preferred embodiment of the invention, the apertures comprise circumferentially spaced slits positioned in the cavity sidewall so that all of the slits have identical cross sectional openings to fuel flow for a given position of the piston within the cavity. Thus, fuel is automatically identically metered to all of the engine cylinders through operation of a single actuator, thereby eliminating individual electromagnetic fuel injectors at the various engine cylinders. In another embodiment of the invention the valve is separate from the cavity.

In the preferred embodiments of the invention, mechanical poppet injectors are positioned at the individual engine cylinders for atomizing fuel delivered to the engine cylinders. The mechanical poppet injectors do not perform a metering function, and therefore any wear at the injectors does not affect quantity of fuel delivered to the cylinders. The cavity of the metering device is also coupled to a pressure regulator and a fuel return line for maintaining substantially constant fuel pressure within the cavity. An engine control unit, preferably a microprocessor-based engine control computer, is coupled to plural sensors responsive to engine operating conditions for controlling position of the linear actuator within the metering cavity.

BRIEF DESCRIPTION OF THE DRAWING

The invention, together with additional objects, features and advantages thereof, will be best understood from the following description, the appended claims and the accompanying drawing in which:

DETAILED DESCRIPTION OF PREFERRED EMBODIMENTS

Figure 1:
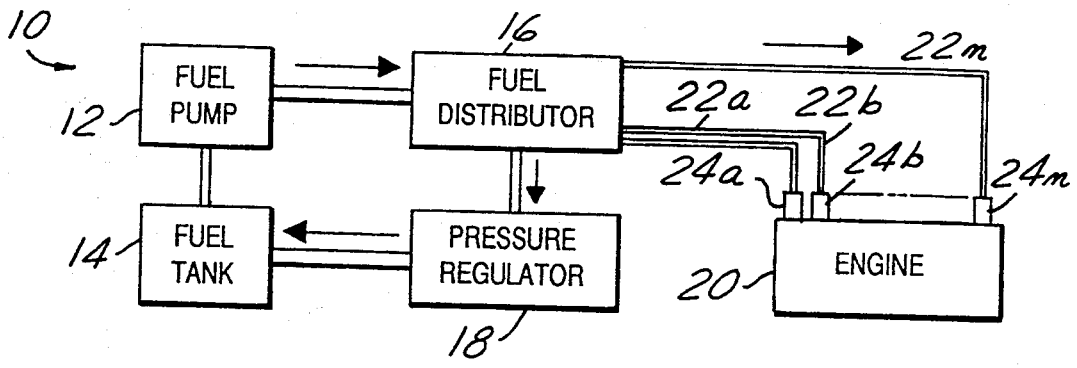
FIG. 1 is a functional block diagram of a fuel delivery system in accordance with a presently preferred embodiment of the invention.

FIG. 1 illustrates a fuel delivery system 10 in accordance with a presently preferred embodiment of the invention as comprising a constant-delivery fuel pump 12 coupled to a fuel tank 14 and thereby forming a source of fuel under pressure to a fuel distributor 16. Fuel pump 10 may comprise a mechanical fuel pump responsive to rotation of the engine crankshaft, or an electric-motor fuel pump responsive to application of battery power. A pressure regulator 18 is coupled to fuel distributor 16 for returning excess fuel to tank 14, and thereby maintaining a substantially constant pressure of fuel within distributor 16 for delivery to the engine 20. Distributor 16 is connected by a plurality of fuel lines 22 to associated injectors 24*a*–24*n* disposed at the individual cylinders of engine 20. Injectors 24a–24n preferably comprise conventional mechanical poppet-type injectors responsive to pressure of fuel in associated lines 22a–22n for delivering and atomizing fuel to the engine air intake manifold immediately adjacent to the fuel intake ports of the individual engine cylinders.

Figure 2:
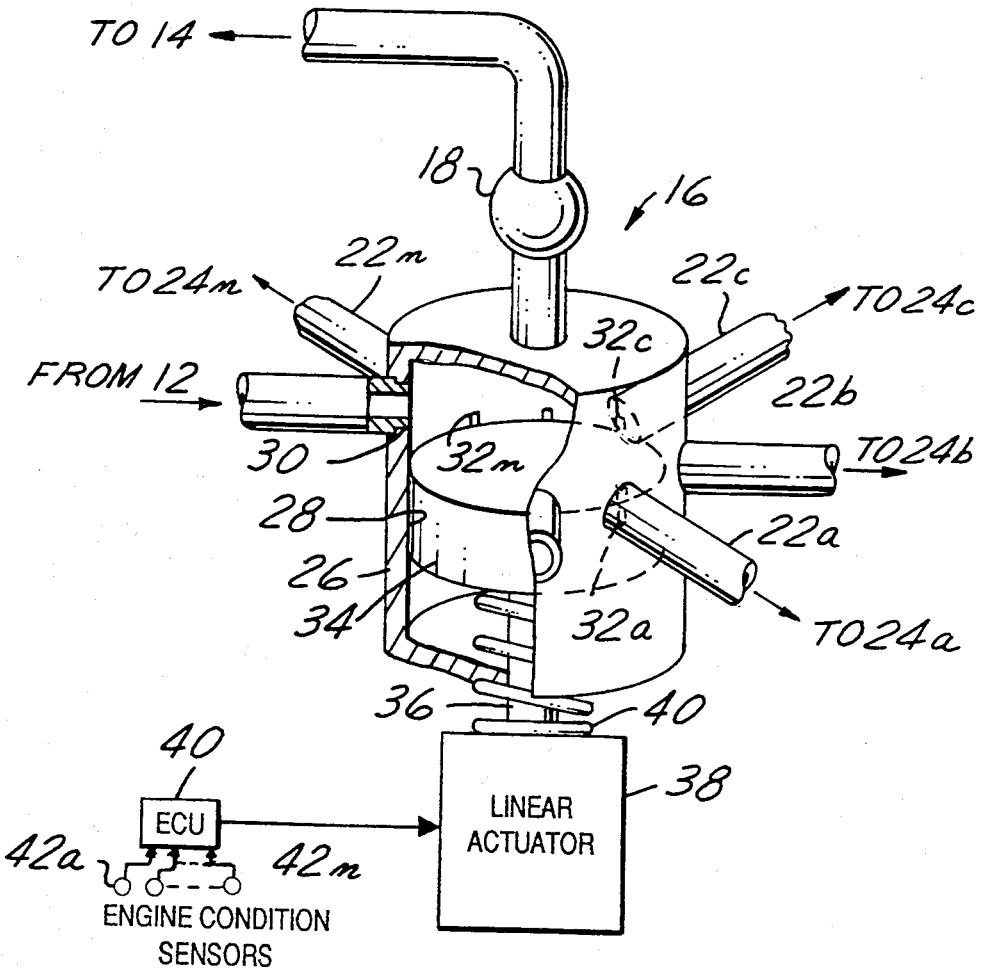
FIG. 2 is a schematic diagram of the fuel distributor illustrated in FIG. 1 coupled to an engine control computer.

As shown in greater detail in FIG. 2, fuel distributor 16 comprises a housing 26 having a substantially cylindrical internal cavity 28. An intake port 30 in the sidewall of housing 26 receives fuel under pressure from pump 12, and an outlet port in the upper end wall of housing 26 is coupled to regulator 18 for returning fuel to tank 24 and thereby maintaining substantially constant fuel pressure within cylindrical cavity 28. A plurality of apertures 32a–32n extend through the sidewall of housing 26 circumferentially spaced from each other and at substantially identical axial position relative to the housing. Apertures 32a–32n in the preferred embodiment of the invention take the form of elongated substantially rectangular parallel slits that extend lengthwise in a direction parallel to the axis of cavity 28. Each slit 32a–32n is coupled to an associated fuel line 22a–22n for feeding fuel from cavity 28 to associated poppet injectors 24a–24n.

A piston 34 is slidably disposed within cavity 28. A piston rod 36 extends from piston 34 through the lower end wall of cavity housing 26, and is connected to an electromagnetic linear actuator 38 for controllably varying position of piston 34 within cavity 28, and thereby effectively and simultaneously controlling cross sectional area to fuel flow at each aperture 32a–32n. A coil spring 40 is captured in compression for normally urging piston 34 to an upward position closing all apertures 32a–32n. The coil(s) of actuator 38 receive a control signal from an engine control unit (ECU) 40 for controlling position of piston 34 within cavity 28. A plurality of engine condition sensors 42a–42m are coupled to engine 20 (FIG. 1) for providing electrical signals as corresponding functions of operating conditions at the engine, and thereby providing input signals to ECU 40. ECU 40 thus provides an appropriate control signal to actuator 38 to control delivery of fuel from cavity 28 to fuel lines 22a–22n and poppets 24a–24n as a function of engine operating conditions.

Sensors 42a–42m may include, for example, a manifold absolute pressure sensor for indicating pressure within the engine air intake manifold, a throttle position sensor for indicating rotation of the engine throttle by the operator and thus engine demand, a water or oil temperature sensor for indicating engine temperature, a sensor for indicating vehicle battery potential, an oxygen sensor responsive to engine exhaust for determining fuel/air ratio, a crank sensor, an ignition sensor for determining rpm, etc. ECU may be of any suitable construction, with the ECU disclosed in U.S. Pat. No. 5,091,858 assigned to the assignee hereof being exemplary. Control algorithms for varying fuel delivery as a function of engine operating conditions do not per se form part of the present invention.

As previously noted, apertures 32a–32n preferably take the form of identically disposed and dimensioned elongated slits that extend in a direction parallel to axial motion of piston 34 within cavity 28. Thus, the cross sectional area to fuel flow at each aperture 32a–32n varies substantially linearly with position of piston 34 within cavity 28. Furthermore, the cross sectional areas to fuel flow of apertures 32a–32n are substantially identical to each other at all positions of piston 34 within cavity 28, so that fuel distributor 16 automatically meters substantially identical quantities of fuel to all cylinders of engine 20. Actuator 38 may have an effective resolution on the order of one millionth of an inch, providing greatly enhanced control of fuel delivery volume. Moreover, slits 32a–32n may have a length dimensioned for delivery of fuel having lowest potential energy content, such as gasahol containing 90% alcohol, and piston 34 may be controlled by actuator 38 to reduce aperture size for fuels of higher energy content.

It will also be appreciated that the fuel source coupled to distributor 16 may comprise systems other than a constant delivery fuel pump 12 and return pressure regulator 18. For example, fuel pump 12 may comprise an electric-motor fuel pump energized in response to fuel pressure within cavity 28, and thereby automatically maintaining substantially constant fuel pressure within cavity 28 while eliminating pressure regulator 18 and the associated return fuel path to tank 14. Poppet valves 24a–24n may be replaced by other conventional mechanical means or devices for atomizing fuel delivered to individual engine cylinders. Linear actuator 38 may be replaced by a stepper motor, or by an electric motor and screw/rack arrangement, in accordance with the broadest aspects of the invention.

Figure 3:
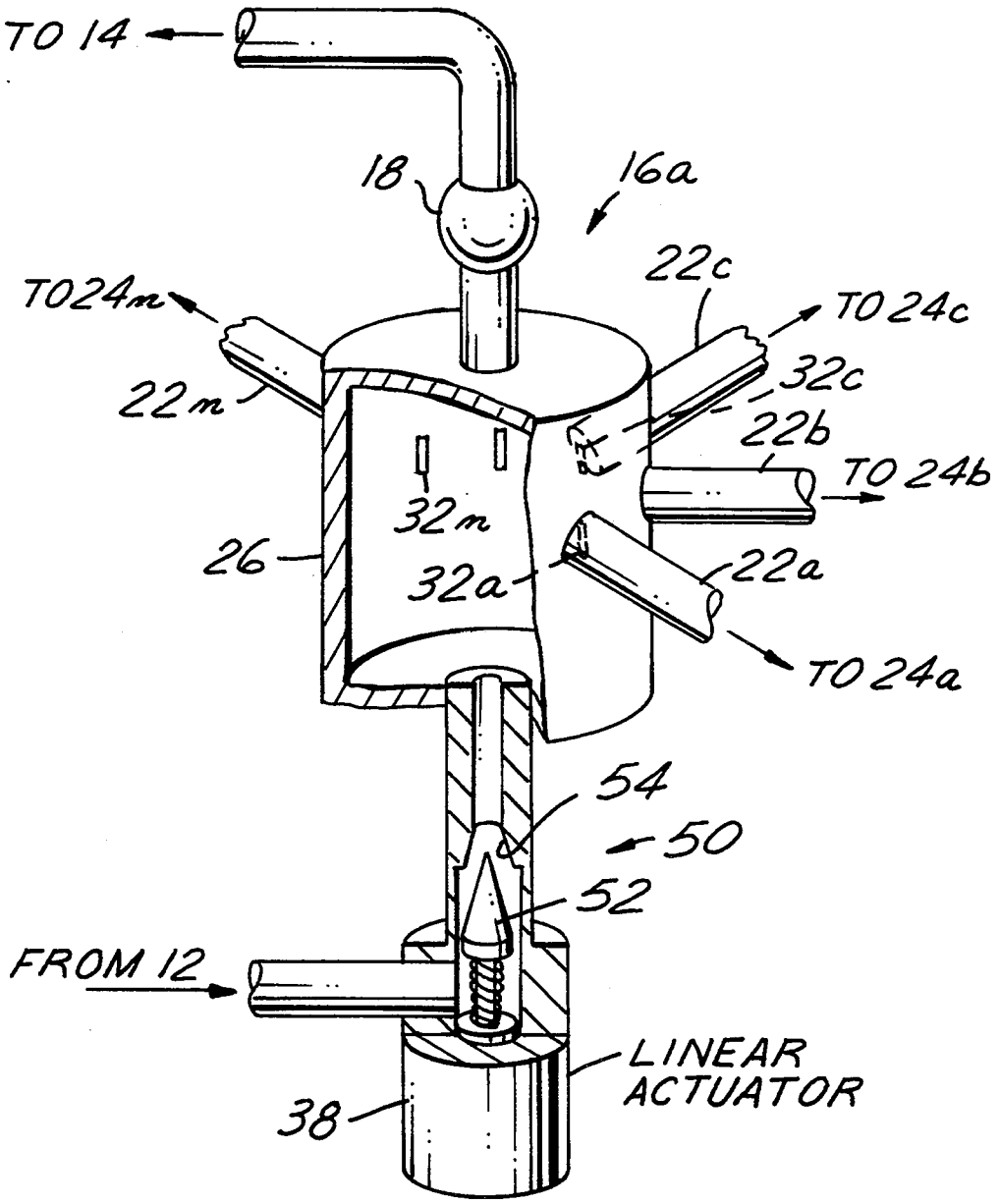
FIG. 3 is a schematic diagram of a modified embodiment of the invention.

FIG. 3 illustrates a modified fuel distributor 16a in which a separate valve 50 is positioned in the fuel line between fuel pump 12 (FIG. 1) and cavity 26. Valve 50 includes a valve element 52 coupled to linear actuator 38 for continuous movement, controlled by actuator 38, between a fully closed position against valve seat 54 and a fully open position (shown). Fuel from valve 50, at volume and pressure controlled by actuator 38, flows to cavity 26, and then equally to injectors 24a–24n (FIG. 1).

I claim:

1. A fuel delivery system for an internal combustion engine having at least one cylinder, said system comprising: a source of fuel under pressure, a fuel line for feeding fuel to the at least one engine cylinder, and fuel metering means for metering fuel under pressure from said source to said fuel line, said fuel metering means comprising a linear electromagnetic actuator, valve means coupled to said actuator and responsive to linear motion imparted to said valve means by said actuator for variably controlling flow of fuel from said source to said line, said valve means and said actuator being continuously variable between fully closed and fully open positions of said valve means, and means for continuously energizing said actuator and thereby controlling flow of fuel through said valve means continuously between said fully closed and fully open positions of said valve means as a function of engine operating conditions, said actuator providing the sole motive force to said valve means responsive to engine operating conditions.

2. The system set forth in claim 1 wherein said valve means comprises a fuel cavity coupled to said source and having a cavity sidewall, and an aperture in said sidewall coupled to said fuel line.

3. The system set forth in claim 2 wherein said valve means further comprises a piston slidably disposed in said cavity and cooperating with said sidewall for opening said aperture to said cavity as a function of position of said piston within said cavity, said linear electromagnetic actuator being coupled to said piston for controlling position of said piston within said cavity.

4. The system set forth in claim 3 wherein said aperture is of rectangular geometry having one linear dimension parallel to motion of said piston within said cylinder such that cross sectional area of said aperture opened by said piston varies as a linear function of position of said piston within said cylinder.

5. The system set forth in claim 3 for supplying fuel to plural engine cylinders, said system comprising a plurality of said fuel lines for individually feeding fuel to the engine cylinders, and a plurality of said apertures circumferentially spaced from each other in said cavity sidewall and individually coupled to said fuel lines.

6. The system set forth in claim 5 wherein said apertures are of identical geometry.

7. The system set forth in claim 4 further comprising means coupled to said cavity for maintaining substantially constant fuel pressure within said cavity.

8. The system set forth in claim 7 wherein said pressure-maintaining means comprises a fuel pressure regulator coupled to said cavity, and a return line coupling said regulator to said source.

9. The system set forth in claim 1 further comprising means disposed at the engine cylinder and coupled to said fuel line for atomizing fuel delivered from said fuel line.

10. The system set forth in claim 9 wherein said atomizing means comprises a mechanical poppet injector.

11. The system set forth in claim 1 wherein said means for energizing said actuator comprises at least one sensor for supplying an electrical signal as a function of an operating condition at the engine, and engine control means responsive to said at least one sensor for variably energizing said actuator.

12. A fuel delivery system for an internal combustion engine having plural cylinders that comprises:

a source of fuel under pressure, fuel metering means that includes a cavity, a plurality of fuel lines individually coupling said cavity to an associated cylinder, and electromagnetic motor means operatively coupled to said cavity for controlling flow of fuel from said source through said cavity and fuel lines, said fuel metering means and said electromagnetic motor means being continuously variable between fully open and fully closed conditions at said metering means, and means for energizing said motor means as a continuously variable function of engine operating conditions between said fully open and said fully closed conditions at said metering means, said motor supplying the sole motive force to said fuel meter means responsive to engine operating conditions.

13. The system set forth in claim 12 wherein said cavity and fuel lines are constructed and arranged such that substantially identical quantities of fuel are fed to the engine cylinders.

* * * * *